United States Patent [19]

Kray

[11] Patent Number: 5,074,484

[45] Date of Patent: Dec. 24, 1991

[54] COROTRON RESTRINGING TOOL

[75] Inventor: William A. Kray, West Seneca, N.Y.

[73] Assignee: Xerox Corporation, Stamford, Conn.

[21] Appl. No.: 544,302

[22] Filed: Jun. 27, 1990

[51] Int. Cl.[5] ..... B65H 49/18

[52] U.S. Cl. ..... 242/129.8; 242/85; 242/106; 242/134

[58] Field of Search ..... 242/129.8, 129.5, 130, 242/134, 137, 138, 141, 146, 107.2, 106, 99, 85; 24/115 L, 115 M, 136 R

[56] References Cited

U.S. PATENT DOCUMENTS

| | | | |
|---|---|---|---|
| 544,342 | 8/1895 | Bower | 24/136 R |
| 904,863 | 11/1908 | Glass et al. | 24/136 R |
| 1,569,699 | 1/1926 | Bergstrom et al. | 242/107.2 |
| 1,806,844 | 5/1931 | Dennis | 24/136 R |
| 1,815,386 | 7/1931 | Willard | 24/136 R |
| 2,529,327 | 11/1950 | Carlson | 24/136 R X |
| 2,537,322 | 1/1951 | Wanzenberg | 24/136 B X |
| 3,499,143 | 3/1970 | Martin | 250/49.5 |
| 3,566,223 | 2/1971 | Salger | 317/262 |
| 3,868,748 | 3/1975 | Kelly | 24/115 M |
| 4,110,811 | 8/1978 | Hubble et al. | 361/225 |
| 4,258,258 | 3/1981 | Laing et al. | 250/324 |

*Primary Examiner*—Stanley N. Gilreath
*Attorney, Agent, or Firm*—William A. Henry, II

[57] ABSTRACT

A corotron restringing tool includes a locking drum downstream from a spool of corotron wire. A torsion spring connected to the locking drum allows wire to be drawn from the spool under a minimum of tension and subsequently manipulated without placing tension on the remaining wire on the spool. An alternative is to use a locking wedge instead of the drum configured such that the harder the wire is pulled, the tighter the wire is held by the wedge.

7 Claims, 3 Drawing Sheets

COROTRON RESTRINGING TOOL

FIELD OF THE INVENTION

The present invention relates generally to corotron used in electrophotographic devices, and more particularly, to restringing tools for repairing such corotrons.

BACKGROUND OF THE INVENTION

In electrostatographic applications such as xerography, a charge retentive surface is electrostatically charged, and exposed to a light pattern of an original image to be reproduced to selectively discharge the surface in accordance therewith. The resulting pattern of charged and discharged areas on that surface forms an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. The process is well known, and is useful for light lens copying from an original, and printing applications from electronically generated or stored originals, where a charged surface may be discharged in a variety of ways.

It is common practice in electrophotography to use corona charging devices to provide electrostatic fields driving various machine operations. Thus, corona charging devices are used to deposit charge on the charge retentive surface prior to exposure to light, to implement toner transfer from the charge retentive surface to the substrate, to neutralize charge on the substrate for removal from the charge retentive surface, and to clean the charge retentive surface after toner has been transferred to the substrate. These corona charging devices normally incorporate at least one coronode held at a high voltage to generate ions or charging current to charge a surface closely adjacent to the device to a uniform voltage potential, and may contain screens and other auxiliary coronodes to regulate the charging current or control the uniformity of charge deposited. A common configuration for corotron corona charging devices is to provide a thin wire coronode tightly suspended between two insulating end blocks which support the coronode in charging position with respect to the photoreceptor and also serve to support connections to the high voltage source required to drive the coronode to corona producing conditions. The coronode is partially enclosed by a conductive shield held at ground potential which serves to increase corona current produced. It is often desirable to have two coronodes within the same structure, which effectively increases the width of the charging zone for the improvement of charging uniformity, and which may be provided by a single wire of double the required length, having free ends of the wire anchored at one end block and a looped end anchored at the opposite end block. It is common in wire coronode structures to provide a spring connector to anchor an end of the coronode to an insulating end block. Scorotron corona charging devices have a similar structure, but are characterized by a conductive screen or grid interposed between the coronode and the photoreceptor surface, and held at a voltage corresponding to the desired charge on the photoreceptor surface. The screen tends to share the corona current with the photoreceptor surface. As the voltage on the photoreceptor surface increases towards the voltage level of the screen, corona current flow to the screen is increased, until all the corona current flows to the screen and no further charging of the photoreceptor takes place. It is to be noted that it is desirable that the screen be supported in a rigid, flat manner, so that it is uniformly spaced from the photoreceptor.

In use, wire coronode corotrons and scorotrons are noted for the ability to produce a reasonably uniform charge on a charge retentive surface. However, over time, the environment to which the coronode is exposed begins to cause irregularities and degradation in charging uniformity. These irregularities may be traced to surface irregularities on the coronode surface which over time becomes pitted, or coated with toner or fuser release agent or other process by-products which must be removed. While cleaning the coronode serves to improve the charging characteristics, coronodes eventually require replacement due to further degradation in performance, or breakage which often occurs while cleaning.

Heretofore, for the purpose of restringing the coronode as a result of one of the above-mentioned problems, technicians have opted for storing corotron wire on a spool in one of the following methods: store the spool in the existing bag and container which offers good protection, but is easily broken; store the spool in a plastic bag which offers protection from hard objects while keeping the spool clean, but it is vulnerable to surface damage; use a rubber band around the spool, but this causes damage to the corotron wire at the time of use; or use no protection of the spool. Obviously, with these methods of storage of corotron wire, there is a high likelihood of damage to the wire which could result in uneven charging that would effect copy quality even before the wire is placed into the machine. Even if one were to pass the above-mentioned obstacles without damage to the corotron wire, there could still be damage to the wire during rewiring. For example, after attaching one end of the wire to an end block, proper tension has to be applied to the wire before it is attached to an opposite end block. This is accomplished in one of the following methods: use the spool to apply tension (this is the easiest method, but causes side surface scratches as the wire forces its way between the remaining wires of the spool); loosen the end blocks, but this causes problems with the end blocks; use pliers to pull the wire taut, which works but often breaks the wire. Therefore, a need has been shown for a restringing tool capable of allowing the rewiring of a corotron and resulting in no damage to the new wire.

In the past a wide variety of arrangements have been used to support coronodes in position with respect to the charging device, and maintain a satisfactory degree of tension on the coronode. Thus, for example, U.S. Pat. No. 3,499,143 to Martin discloses a corona charging device including a spool of wire supported within the device so that is readily available for use. The spool is supported so that it is selectably rotatable to remove wire from the spool for stringing the device, or to hold the end of the coronode in a fixed position. At an opposite end of the corona charging device, a pulley is provided around which the wire is supported and returned to the spool end of the device, where the free end of the wire is anchorable with a screw. A spring biased lever rotates the spool until the wire is in a taut condition, prior to fixing the free end at the screw anchor. This arrangement requires significant judgement in the installation of the wire, observing the wire and spring tension. U.S. Pat. No. 4,110,811 to Hubble, III et al. discloses a useful arrangement which removes most judgement from the installation, providing a compression spring fixed to a coronode wire at a first end and a fixed ball terminator at a second end, and relies on the compression spring to maintain tension. Such a termination arrangement is relatively expensive, however, and the dielectric materials commonly used for the terminations cannot withstand long exposures to high voltages normally found in corona devices. U.S. Pat. No. 4,258,258 to Laing et al. shows a generally similar arrangement in which one end of a coronode is provided with a bead termination and supported within a channel, while the other end extends through an insert to a tensioning means, where cooperating collars serve to retain the coronode end in the insert against any force pulling it out of the insert. Inserts supporting the coronode in position can be made chemically non-reactive. U.S. Pat. No. 3,566,223 to Salger teaches an adjustable wedge-type clamping mechanism. One end of the corona charging device includes a double clamping arrangement to fix both ends of the wire in position, while the opposite end provides a spring loaded abutment, wherein tension on the wire is achieved by removal of the spring.

SUMMARY OF THE INVENTION

In accordance with the invention there is provided a corotron restringing tool capable of storing a spool of corotron wire, while allowing a technician the ability to restring a corotron, applying negligible or no tension to the stored spool.

In accordance with one aspect of the invention, a corotron restringing tool includes a locking drum downstream from a spool of corotron wire. The locking drum allows wire to be drawn from the spool and subsequently placed under tension without placing tension on the remaining wire on the spool. In an alternative aspect of the invention, a locking wedge is used to allow wire to be drawn from the spool under tension without placing tension on the remaining wire on the spool since the more force one places on the wire the more locking force is placed on the wire.

The described arrangement finds particular utility for technicians because time is utilized better with minimum rewiring time and with better wire and less rewiring.

BRIEF DESCRIPTION OF THE DRAWINGS

These and other aspects of the invention will become apparent from the following description used to illustrate a preferred embodiment of the invention read in conjunction with the accompanying drawings in which.

DETAILED DESCRIPTION OF THE DRAWINGS

Figure 1:
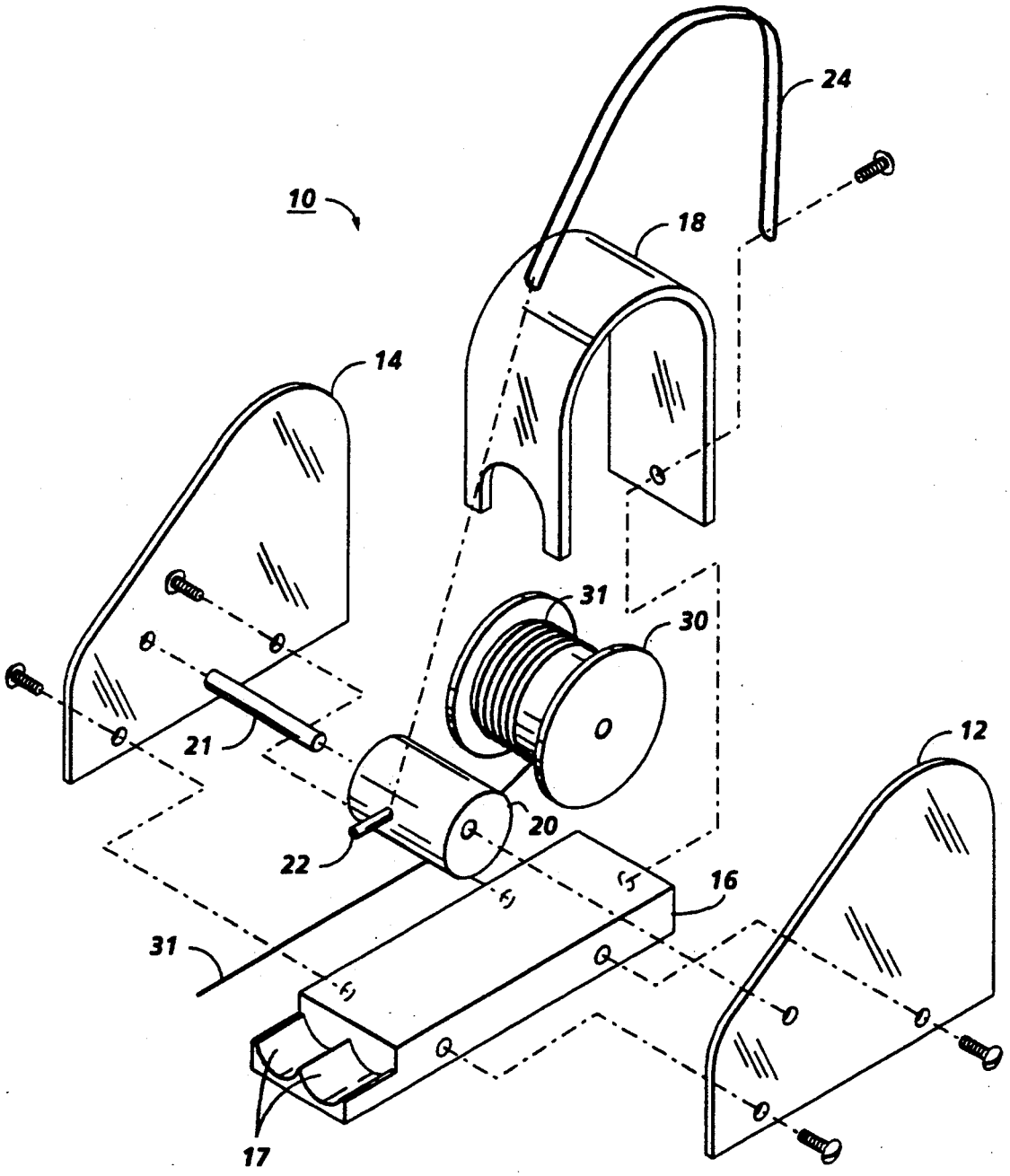
FIG. 1 is a partially exploded perspective view of a corotron restringing tool in accordance with an aspect of the present invention.

Referring now to the drawings where the showings are for the purpose of describing embodiments of the invention and not for limiting same, FIG. 1 shows a corotron restringing tool 10. Corotron restringing tool 10 is generally provided with right and left side plates 12 and 14, a base member 16, a cover member 18, a locking drum 20 having an off-centered eccentrically mounted release handle 22 with respect to the drum attached thereto and an eccentrically positioned locking drum mounting shaft 21. A flexible band 24 holds cover 18 in place on top of base member 16. Flexible or elastic band 24 is critical in that it serves the dual function of maintaining cover 24 in a fixed position while simultaneously applying a clockwise tension (i.e., when viewing the restringing tool from right side plate 12) to the release handle 22 of locking drum 20, the purpose of which will be explained in more detail hereinafter. Spool 30 is supported under cover 18 and includes corotron restringing wire 31 wound therearound for payout along base member 16 and under drum 20 above either of troughs 17 in base member 16. Tool 10 stores a spool of corotron wire while allowing a technician the ability to restring a corotron while applying no tension to the storage spool as has heretofore been the cause of many problems. In use, tool 10 employs a securing/tensioning device other than the spool, allowing just enough tension to be applied to the wire. This is accomplished by a counter clockwise pressure (i.e., when viewing the restringing tool from right side plate 12) being applied to release handle 22 of locking drum 20 by flexible band 24. The drum is lifted away from the wire a sufficient amount by pressing down on release handle 24 to allow wire to play out from the spool. The wire can be attached to a mounting block of a corotron device for restringing purposes and played out to the length necessary for attachment to a second mounting block with a small amount of pull on the wire since drum 20 has been lifted by pressure on release handle 24. Release of handle 24 will cause drum 20 to rotate clockwise and apply pressure to the wire, thereby protecting the wire against stretching and causing "hot spots" in the wire once it is mounted, as well as, against breaking as the wire is pulled tightly for mounting purposes. It should be appreciated that flexible band 24 is critical in that it has to apply enough pressure to release handle 22 that wire 31 cannot be withdrawn form spool 30, while simultaneously being responsive to the application of force to release handle 22.

A number of advantages over restring approaches of the past are attained with use of restring tool 10. For example, surface damage is held to a minimum, which means that "hot spots" and quality variations are minimized; wire remaining on the spool is always protected thereby allowing use of the full spool of wire; only necessary wire is removed from the spool resulting in minimum waste; lower call rates for technicians due to corotron wire problems are experienced; and consistency between technicians is higher meaning more stability in machine operation. While restringing tool 10 is shown made of plastic, it should be understood that this is exemplary only and that the tool can be made of any material desired.

Figure 2:
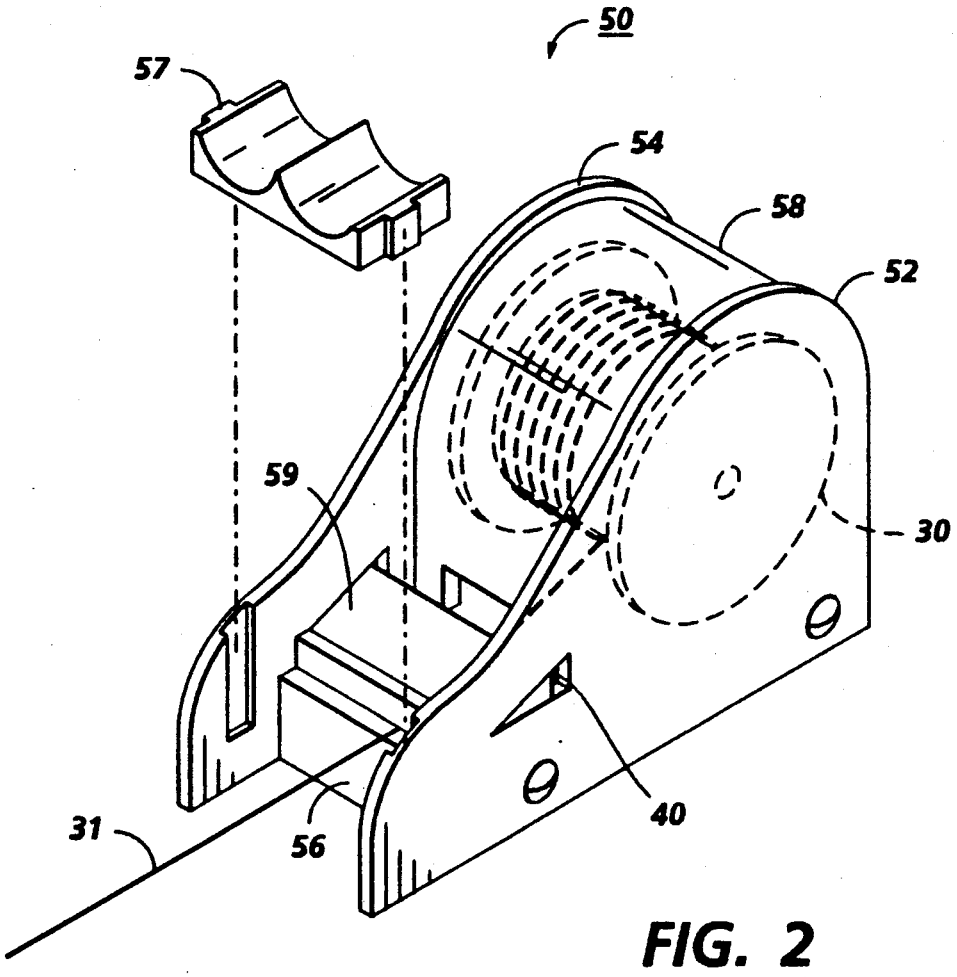
FIG. 2 is an enlarged partially exploded perspective view of a corotron restring tool in accordance with another aspect of the present invention.
Figure 3:
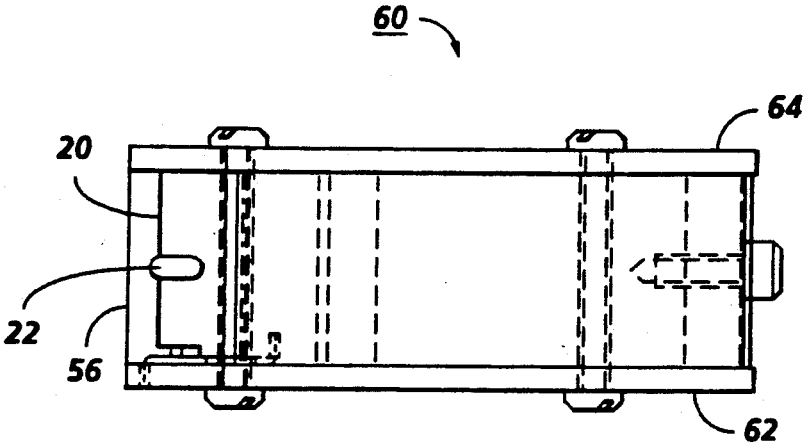
FIGS. 3 and 4 show plan and side views, respectively, of the preferred embodiment of the corotron restringing tool of the present invention.
Figure 4:
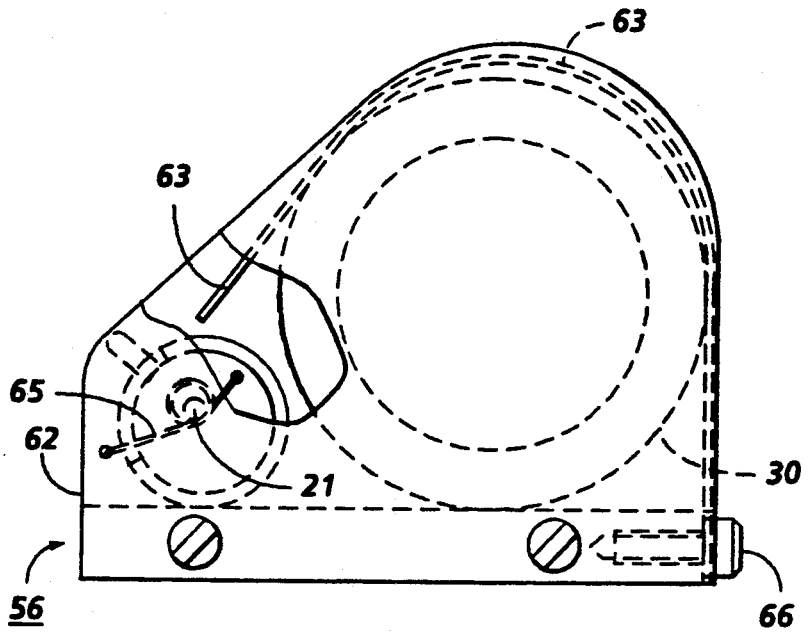

An alternative embodiment of the present invention is shown in FIG. 2 where like numbers are used for parts similar to those of FIG. 1. Restringing tool 50 has a length of corotron wire 31 supported on a spool 30 which in turn is supported for rotary movement between right and left side plates 52 and 54 that are attached to a base member 56. A cover 58, liftable for access to the spool for replacement purposes, encases the spool and protects the wire on the spool. A locking wedge 59 is positioned downstream of the spool and adapted for slidable movement in a horizontal plane within wedge shaped openings 40 in side plates 52 and 54 that have inclined portions which form an angle with horizontal portions. Removable corotron support unit 57, situated downstream of locking wedge 59 may be changed to suit various corotron mounting configurations. In use, wire is threaded underneath wedge 59 and past corotron support unit 57 and attached to a support block of a corotron device. Wedge 59 is configured (i.e., the angle of the inclined portion of the wedge is slightly greater than the angle of the inclined portion of wedge shaped openings 40 in side plate 52 and 54) positioned and adapted such that a small force can be applied to wire 31 causing it to rotate spool 30. However, too much force (pull) on the wire will result in wedge 59 sliding toward corotron support unit 57, thereby applying sufficient pressure to wire 31 to impede playout of the wire. The coefficient of friction between corotron wire 31 and the horizontal surface of wedge 59 work cooperatively with the predetermined configuration of openings 40 such that a small amount of pull on wire 31 will cause wedge 59 to slide horizontally toward the intersection of inclined and horizontal portion of openings 40 until it is stopped by the inclined portions of the wall openings. Since the locking wedge has a greater angle than the opening in walls 40, a sudden jerk of the wire will cause the wedge to jam into that portion of openings 40 that is downstream from wire 31 and apply pressure to the wire and impede playout of the wire.

A preferred embodiment of the present invention is a corotron restringing tool configured as corotron wire dispenser 60. The corotron wire dispenser is a tool designed to reduce wire waste and save time during the restringing of corotrons. The dispenser protects spooled wire, both during dispensing and in storage. The dispenser is made from a tough plastic—polycarbonate and consists of an eccentric cam which locks wire down at the front of the tool and an aluminum cover which prevents the wire from unraveling and protects the spool from contamination. Corotron dispenser 60 is generally provided with right and left side plates 62 and 64, a base member 56, a cover member 63, the significance of which being that it should be adjusted/-reformed to allow for smooth dispensing while offering enough resistance to prevent unraveling of wire during storage, a locking cam or drum 20 having an off-centered eccentrically mounted release handle 22 with respect to the drum attached thereto and an eccentrically positioned locking drum mounting shaft 21. Flexible cover 63 is attached to base 56 by screw 66 and bent over spool 30 to make contact with spool 30 at two points to prevent wire from unraveling over the sides of the spool. Torsion spring 65 is critical in that it applies a clockwise tension to the release handle 22 of locking drum 20, the purpose of which will be explained in more detail hereinafter. Spool 30 is supported under cover 63 and includes corotron restringing wire 31 wound therearound for payout along base member 56 and under drum 20. Dispenser 60 stores a spool of corotron wire while allowing a technician the ability to restring a corotron while applying no tension to the storage spool as has heretofore been the cause of many problems. In use, release handle 22 on eccentric cam 20 is pushed forward to release the wire. In one smooth motion, a sufficient length of wire is dispensed to restring the corotron. The wire is routed under a clamp washer of the corotron device to be restrung and a clamp washer screw is tightened. The release handle is released and pulled back to ensure that the wire is captured by the eccentric cam. This assures that spool wire damage will not occur as one mounts the wire as heretofore described under an opposing washer which is the next step in the restringing process. Because the drum 20 through spring 65 locks down the wire near the front of the base 56, one can use the dispenser as a tensioning device without risking damage to the coating on the wire. Obviously, this dispenser prevents premature wire failure due to mishandling during the restringing process. It also cuts down on the time to restring corotrons and lessens waste material encountered during this activity.

It should now be apparent that a corotron restringing tool has been disclosed that protects the wire in a technician's tool bag, as well as, during the process of dispensing. It also assits the technician during the restringing of corotrons. In addition, the tool protects spooled wire by locking down the wire near the front of the tool so that one will not be pulling on subsequent strands of wire on the spool during tensioning.

The invention has been described with reference to a preferred embodiment. Obviously modifications will occur to others upon reading and understanding the specification taken together with the drawings. This embodiment is but one example, and various alternatives, modifications, variations or improvements may be made by those skilled in the art from this teaching which are intended to be encompassed by the following claims.

I claim:

1. A tool for stringing wire onto a device without damage to the wire, comprising:

a housing member including a base portion and two side portions attachable to said base portion, said side portions each having a wedge shaped opening therein;

a support member mounted for rotary movement within said housing;

wire wound around said support member; and wedge shaped pressure member positioned within said wedge shaped openings downstream of said support member and immediately adjacent said base portion with said wire passing thereunder, and wherein the coefficient of friction between said wire and said wedge shaped pressure member and the configuration of said wedge shaped member with respect to said wedge shaped openings are such that a first and constant pulling force against said wire will cause said wire to play out from said support member and said wedge shape pressure member to slide to a first position within said wedge shaped openings, and wherein a second and increased pulling force will cause said wedge shaped pressure member to jam into inclined portions of said wedge shaped openings and thereby increase pressure against said wire and inhibit movement of said wire.

2. A small, compact corotron restringing tool for restringing corotron wire onto corotrons or the like without damage to the wire, comprising:

a horizontal base member;

a spool supported for rotary movement upon said base member;

corotron wire supported on said spool:

first and second side members adapted to be connected to said base member and extend in a plane orthogonal to said base member;

cover member attached to said base and enclosing said spool;

a shaft supported by said first and second side members;

a smooth surfaced drum eccentrically mounted on said shaft and positioned downstream of said spool and immediately adjacent said base member with said corotron wire passing thereunder;

a release handle attached to and extending from a longitudinal surface portion of said drum; and spring means having a first portion surrounding said shaft, a second portion connected to said drum and a third portion connected to one of said side members and adapted such that pressure on said release handle causes said eccentrically mounted drum to rotate counterclockwise away from said corotron wire so that the wire can be freely dispensed from said spool and wherein subsequent release of said release handle causes said drum to apply a force against said corotron wire and thereby prevent tensioning of said wire upstream of said drum.

3. The corotron restringing tool of claim 2, wherein said release handle is attached to said drum below said shaft and extends from the outer surface of said drum at an acute angle with respect to a horizontal plane through said shaft.

4. The corotron restringing tool of claim 3, wherein said release handle attached to said drum is mounted off-center with respect to a lengthwise dimension of said drum.

5. The corotron restringing tool of claim 4, wherein said third portion of said spring means is connected to an inside surface of said first side member and said second portion of said spring means is connected to an end surface of said drum that is adjacent said inside surface of said first side member.

6. The corotron restringing tool of claim 2, wherein said spring means is a torsion spring.

7. A small, compact corotron restringing tool for restringing corotron wire onto corotons or the like without damage to the wire, comprising:

a horizontal base member;

a spool supported for rotary movement upon said base member;

corotron wire supported on said spool;

first and second side members adapted to be connected to said base member and extend in a plane orthogonal to said base member;

cover member attached to said base and enclosing said spool;

a shaft supported by said first and second side members;

a smooth surfaced drum eccentrically mounted on said shaft and positioned downstream of said spool and immediately adjacent said base member with said corotron wire passing thereunder;

a release handle attached to a longitudinal surface portion of said drum; and an elastic member having a first end attached to said base member, a second end attached to said release handle and a portion in between said first and second ends extending over the outside surface of and touching a portion of said cover member and adapted such that pressure on said release handle causes said eccentrically mounted drum to rotate counterclockwise away from said corotron wire so that the wire can be freely dispensed from said spool and wherein subsequent release of said release handle causes said drum to apply a force against said corotron wire and thereby prevent tensioning of said wire upstream of said drum.

* * * * *